United States Patent [19]

Dupper et al.

[11] Patent Number: 4,635,321

[45] Date of Patent: Jan. 13, 1987

[54] SPINNING MACHINES AND THE LIKE WITH SIGNAL OR INDICATOR DEVICES

[75] Inventors: Walter Dupper, Eschenbach; Roland Emberger, Süssen; Kurt Hack; Manfred Lattner, both of Ebersbach; Helmut Nickolay, Göppingen; Karl Riedel, Ebersbach; Richard Schöllhammer, Göppingen, all of Fed. Rep. of Germany

[73] Assignee: Zinser Textilmaschinen GmbH, Ebersbach, Fed. Rep. of Germany

[21] Appl. No.: 703,838

[22] Filed: Feb. 21, 1985

[30] Foreign Application Priority Data

Feb. 21, 1984 [DE] Fed. Rep. of Germany ..... 3406215
Jun. 15, 1984 [DE] Fed. Rep. of Germany ..... 3422270

[51] Int. Cl.[4] ..... D01H 13/14; D01H 5/40

[52] U.S. Cl. ..... 19/0.25; 19/236; 19/258

[58] Field of Search ..... 19/0.22, 0.25, 236, 19/239, 258, 270

[56] References Cited

U.S. PATENT DOCUMENTS

| | | | |
|---|---|---|---|
| 3,124,843 | 3/1964 | Adams et al. | 19/0.25 |
| 4,030,281 | 6/1977 | Schopper et al. | 19/0.25 |
| 4,432,195 | 2/1984 | Stahlecker | 19/0.25 X |
| 4,510,645 | 4/1985 | Glock | 19/0.25 |

*Primary Examiner*—Louis K. Rimrodt
*Attorney, Agent, or Firm*—Karl F. Ross; Herbert Dubno

[57] ABSTRACT

Spinning machine in which the upper rollers of the drafting units are arranged at pressure arm assemblies, whereby each pressure arm assembly has a main arm and an operating lever which is positionally arranged above the main arm and radially movable. To each work location of the machine are assigned signal lights for indicating disruptions at the work location. For optimum visibility from distant locations, the indicator lights are provided at the operating levers.

20 Claims, 11 Drawing Figures

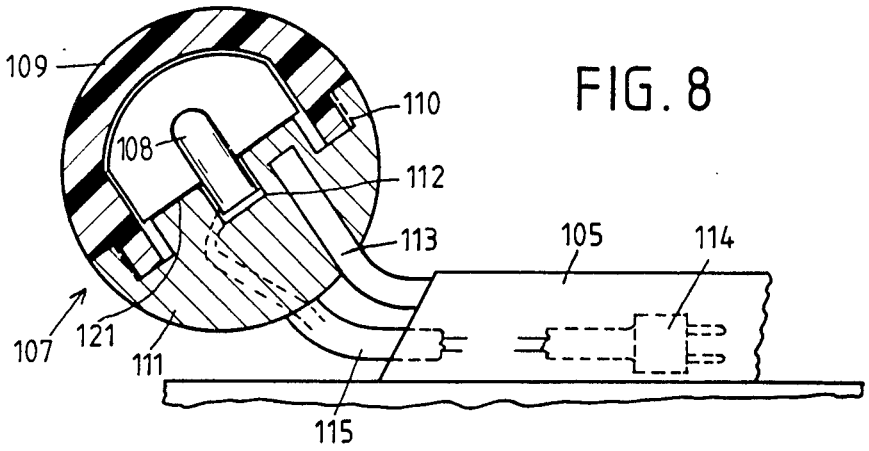
FIG. 8
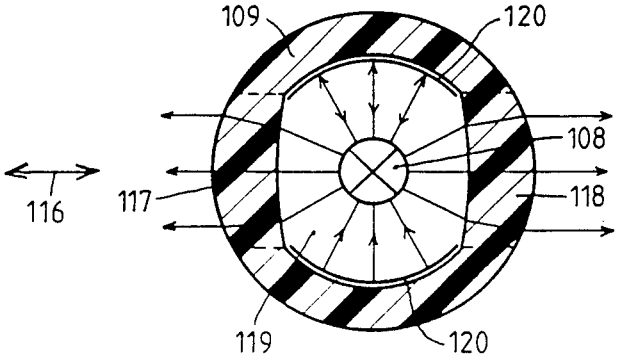
FIG. 9
FIG. 10
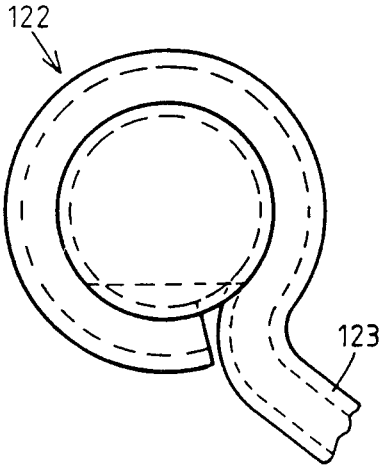
FIG. 11
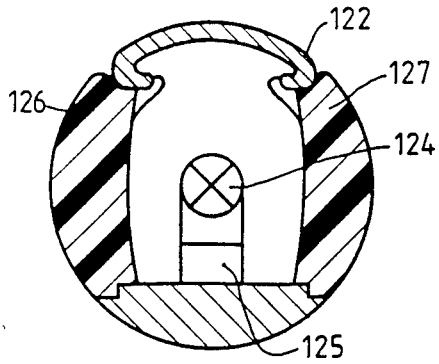

SPINNING MACHINES AND THE LIKE WITH SIGNAL OR INDICATOR DEVICES

FIELD OF THE INVENTION

Our present invention relates to spinning machines and, more particularly, to spinning machines with indicator or alarm devices which are operative upon yarn or roving breakage or when a disruption or similar problem requires attention and rectification.

BACKGROUND OF THE INVENTION

Spinning machines for yarn and roving, especially ring spinning machines or flyer spinning machines, generally include pressure arm assemblies at each spinning station acting to apply upper drafting or drawing rollers to the lower rollers so that the roving, thread, filament, band or yarn is clamped in the nip of the resulting roller pair. These pressure or pressing arm assemblies generally comprise a main arm against which are braced the springs which serve to apply pressure to the associated upper rollers, and comprise guides for the upper rollers. The pressure arm assemblies also can each have an operating lever arranged above the main arm and angularly movable to correspondingly displace the main arm. This operating lever serves to transfer the main arm between its pressure-exerting position and its lifted or inactive position in which it does not exert pressure. Each work location of the machine can be equipped with a signal light for signaling disruptions at such work location.

A ring spinning frame of this type is known to have been in use in the Federal Republic of Germany in which each spinning location has a signalling light. This light is arranged on a carrier which, in turn, is arranged above the spindle of the respective spinning location and between two adjacent pressure-exerting assemblies. The light is switched to an "on" state by automatic actuation of a switch when a problem arises, for example when the filament yarn or roving breaks.

When the disruption is corrected or remedied, the associated switch is turned "off" and the light is "out".

It is a significant disadvantage in the known apparatus that the visibility of the indicator light or lights is rather poor, especially from a distance. In addition, the manner in which the signal lights are secured to the respective components is relatively cumbersome and this can easily lead to problems in operating the apparatus.

OBJECTS OF THE INVENTION

It is therefore the principal object of this invention to provide an improved ring or flyer spinning frame with means for monitoring thread breakage in which the signal lights can easily be seen by the operator from considerable distances.

It is also an object of the invention to provide a spinning machine of the type described with an economical signalling arrangement.

It is furthermore an object of our invention to provide signalling devices which are easily installed at respective operating locations.

SUMMARY OF THE INVENTION

These objects are attained in accordance with the invention by mounting the signal lights directly upon the respective operating levers of the pressure arm assemblies.

In this particularly advantageous arrangement, the signal or monitoring lights are visible from a considerable distance, inasmuch as they can be located at the raised or protruding ends of the respective operating levers. This leads to a quick location of broken or discontinuous filaments and, accordingly, reduces the attendant downtimes of the spinning apparatus.

The invention provides the opportunity to position the conduit for supplying electrical current at the pressure arm assemblies.

The positioning of the signal lights at the operating levers can be achieved in a simple and economical manner. It is also easily possible to equip existing spinning or similar machines with the signal lights in accordance with one aspect of the invention.

Inasmuch as a given pressure arm assembly is normally associated with two spinning or twisting locations in the spinning machine, i.e. it supports the respective upper rollers for both stations, it is advantageous that a respective signal light be provided for each spinning station upon the common pressure assembly; each one of these signal lights serves to indicate disruption at the respective spinning or twisting location.

It is also possible in accordance with the invention that fewer signal lights are used; for example only every other or third pressure arm assembly can be equipped with a signal light. Of course, each of such spaced signal lights will be adapted to indicate disruptions or problems at the associated four or six operating locations in a clearly visible manner.

It is further contemplated that several signal or indicator lights are used at the operating lever which will be operative for different spinning locations and responsive to various types of disruptions. When different types of disruptions are to be indicated it is contemplated that the signal lights have a corresponding number of lamps. Advantageously, these may be of different colors. Accordingly, an operator will be warned from a considerable distance what type of disruption has occurred at a spinning location, because of the particular color of the the light that signals the problem.

In other cases it may be more desirable to indicate different disruptions by the same signal light because the operator or service person would be able to easily determine the type of disruption on arriving at the location.

The signal lights in accordance with one aspect of the invention are well protected against damage and do not affect the operation and servicing of the machine.

In accordance with another aspect of the invention, the operating lever of the pressure arm assembly includes a radially movable or swingable arm. In the respective closed position or condition, this arm extends along and lies on the main arm of the respective pressure arm assembly. This affords a particularly convenient arrangement of the signal light at the respective operating lever when the respective lamp holder is releasably arranged at the arm of this operating lever. The holder will carry at least one signal light or unit.

It is also preferred that the signal lamp or lamps of the signal light be arranged atop the arm of the operating lever when this is in the closed condition, because they are then particularly well visible. This applies particularly when the signal lights and/or lamps are arranged on the arm of the operating lever and on the forward half thereof, considered with respect to its longitudinal extent, which half or end is directed away from the support structure for the pressure arm assembly.

Moreover, the signal light can advantageously be installed in the arm of the operating lever and respective windows can be provided in the lateral walls to permit the signal light to shine through while the wall will provide positive protection in the interior of the arm for the light or lights.

The holder for the light can be arranged at the arm of the operating lever. It is also preferred that the holder have a longitudinal configuration, i.e. be elongated and extend in the longitudinal direction of the arm for the operating lever, preferably over more than one-half of the respective length of this arm. The holder can rest on the arm of or for the operating lever.

For enhancing the overall visibility it is also preferred that the signal light or several light units be provided at the forward half of the arm when considered in the longitudinal extent thereof.

In accordance with another feature, the holder for the light includes a channel, or similar opening or groove, for the respective conduit or conduits supplying current to the signal light or light units. This channel extends in the longitudinal direction of the holder and positively protects the conduits.

In accordance with yet another preferred embodiment, the holder for the light or lights can be part of the light or signal light unit, and at it is arranged at least one signal lamp or bulb. It is also preferred that the holder include one or more sockets for the signal lamp or lamps, whereby an inoperative lamp can readily be replaced. The holder for the light furthermore provides the advantage that one or more supply conduits for respective lamps are protected in its channel formation, wherefore the channel formation extends in rearward direction at least close to the respective support frame of the pressure arm assembly.

In accordance with another feature the holder is releasably mounted on the arm of the operating lever. This can be achieved with the aid of lateral and movable leg or wall formations. The wall formations can include base formations which enhance the clamping action and which positively secure the holder to the respective arm, i.e. in a vise-like or clamping manner. It is also within the scope of the invention to provide male connectors, or similar plug-type elements, for engagement in corresponding female apertures, for releasably connecting the holder at the arm of the operating lever. The connectors are integrally formed at the arm for positive attaching of a respective holder. They can be resilient and radially compressible and can be locked to the respective arm. As well, use can be made of a detent connection and other securement means can be used, of course. For example, it is also preferable that the holder for the light is secured by screws or similar fasteners, either releasably or non-releasably, including, securing by means of an adhesive.

We also can have the knob or handle of the pressure arm assembly formed as a signal light. Since such handles or handle means are part of the pressure arm assembly as a matter of course, they can readily be utilized for this purpose.

Thus the handle-grip or similar handle or handle means can be formed as an element which can contain a signal lamp. This element is then at least in part made of a transparent or translucent material. It is preferred that the element which contains the lamp be a sphere or similar round element.

Preferably the handle-grip includes at least one removable cover assembly.

The mobility of the pressure arm assembly is not affected by the disruption-indicating functions or elements. Furthermore, it is also possible according to the invention to outfit existing pressure arm assemblies easily with the signal lamp assembly. The signal lamp which is provided in the handle element can be connected to a source of electrical current by means of a flexible conduit, preferably with a plug-type contact. The conduit also connects the lamp with a sender (transmitter) or indicator arranged at the spinning machine. Some indicators or senders include precursor-stop signalers, indicators or thread breakage, and indicators of damage to the spinning machine.

The handle-grips or handle ends of the pressure arm assemblies are usually sequentially arranged in a horizontal row along the spinning machine. Customarily two spinning machines are arranged in a face-to-face relationship with a walkway for operators between them. It is accordingly also preferred that the supervision of the machines from one or the other end of the walkway can encompass all signal lights on at least one spinning machine or side; and that they can be observed simultaneously. This can be ensured in accordance with a feature of the invention whereby the signal lights have collector or focussing lenses which direct the respective light signal or light beam in the longitudinal direction of the spinning machine, or of the main arm or arms of the pressure arm assemblies.

The collecting lenses ensure that the respective indicator light is focused, or bundled as it were, and at least in the direction of both sides from a respective arm. Even in a bright environment and during bright daylight or strong illumination of the building, a disruption is clearly visible by means of the bundled light.

In order to avoid blinding or the like when the signal lamp is illuminated for lengthy periods of time, e.g. when one stands immediately in front of such lights, it is also preferred that the hollow space which surrounds the signal lamp be covered, but not the collecting lenses, so as to prevent penetration of light. Thus it is also preferred that the walls of the hollow space be covered with a mirror coating or similarly reflecting material. This will enhance the effect of the collecting lenses and prevent an undue heating of the handle-grip or handle end.

A simple yet sturdy construction and a positive protection of the signal light are achieved when the handle has an eyelet or annular configuration. The pertaining signal light and/or lamp is then arranged in the interior of the eyelet structure.

BRIEF DESCRIPTION OF THE DRAWING

The above and other objects, features and advantages will become more readily apparent from the following description, reference being made to the accompanying drawing in which:

FIG. 8 is a longitudinal cross section of FIG. 7;

FIG. 9 is a transverse cross section of FIG. 8;

FIG. 10 is a side elevation showing another embodiment of an operating lever end; and FIG. 11 is a cross section through a further embodiment of an operating lever end.

SPECIFIC DESCRIPTION

Figure 6:
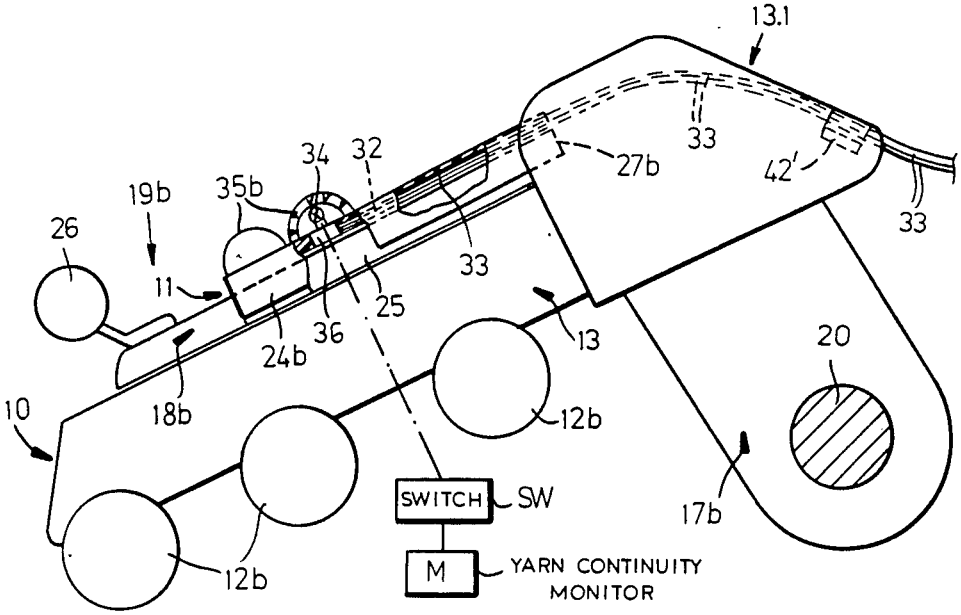
FIG. 6 is a side elevation similar to FIG. 1 of a further embodiment of the invention in which the indicator light is arranged at the respective operating lever.

The pressure arm or pressure arm assembly 10 is generally a standard product as for example made by SKF Kugellagerfabriken, Stuttgart - Bad Cannstatt, Germany. In accordance with the embodiment of the invention shown in FIG. 1, a signal light or indicator light 11 in accordance with one aspect of the invention is secured at the pressure arm assembly 10. This indicator light is also referred to as a signal light unit 11.

The pressure arm 10 has the configuration of a so-called pendulum-carrier i.e. tends to swing downwardly by its weight. It includes a main arm 13 and guide elements. The pressure arm 10 supports rollers of a drawing or drafting device, namely the three illustrated upper rollers 12, by way of the guide elements 14 which are linked in the main arm 13. These rollers 12 are subjected to the force of respective springs 14.1 represented schematically, or they are similarly biased.

When the pressure arm assembly 10 is in the closed condition, the upper rollers 12 are resiliently pressed into contact against the lower rollers 15 of the drawing or drafting roll assembly.

The support frame 17 of the pressure arm assembly includes two spaced-apart vertical side arms or similar lateral plates 16 which extend parallel with respect to one another. In the side elevations only one side arm 16 is shown. The main arm 13 is arranged in the intermediate space between the two side arms 16 and it is journaled such that it can be swung from the shown operating position into an open or rest position. The respective movement from one position into the other is by way of the operating lever or handle 19. The operating lever is also disposed in the intermediate space between the two side arms 16 with its respective ends, as well as being journaled at the support frame 17 so that it can carry out its respective actuation function.

The operating lever 19 includes a longitudinal arm 18 which extends on and along the upper side of the main arm 13 when in the shown closed or operating position. The operating lever 19 also includes at its arm 18 a knob 26, handle-grip, or similar grip element, which serves in the manual movement, i.e. swinging up and down, to bring the main arm 13 into and out of the position corresponding to the pressure-exerting position of arm 13. Specifically, this knob 26 is secured at the end of a short rod 23.

The support frame 17 is fixed at a horizontal shaft 20 of the frame of the spinning machine. The spinning machine is preferably a circular or ring spinning machine, or a so-called flyer spinoff-machine. As mentioned, the support frame is part of or belongs to the pressure arm assembly 10.

The indicator light 11 is releasably arranged on the arm 18 where it is held frictionally and in form-locking and/or force-locking manner i.e. in a manner which provides generally a unitary structure. The indicator light 11 has a track-like holder 27 for the respective light unit 11. This holder 27 is made of an insulating plastic/synthetic resin material. The holder 27 extends in longitudinal direction from a point near the forward end of the arm 18 to the longitudinal center or fully along arm 18 at least up to a point near the side arms 16.

The holder 27 is preferably fully made of a translucent plastic/synthetic material, for example by direct injection molding or similar techniques. The cross section of the holder 27 is preferably continuously u-shaped. Thus, the holder 27 has an upper or top wall 21 and lateral legs or members 24. A slot 22 (FIG. 2) is provided in the upper wall 21 for the short rod 23 which is inclined in upward direction to pass through the slot 22 which will be widened as required at this penetrating location.

The downwardly directed legs or members 24 of the holder 27 have sufficient resiliency to allow spreading thereof, and they will sufficiently grip or engage the corresponding sides or walls 25 of the arm 18 so that the holder 27 is securely positioned and held. The top wall 21 is generally resting on the upper surface or wall of arm 18, but a channel 32 is provided in the top wall 21, which channel 32 is provided in the top wall 21, which channel 32 is open towards the upper surface or wall of the arm 18. The channel 32 extends centrally in the top wall 21 and it is of sufficient depth and width to contain the conduit 33 which supplies electric current to the signal lamp 34 of the indicator light 11.

Figure 1:
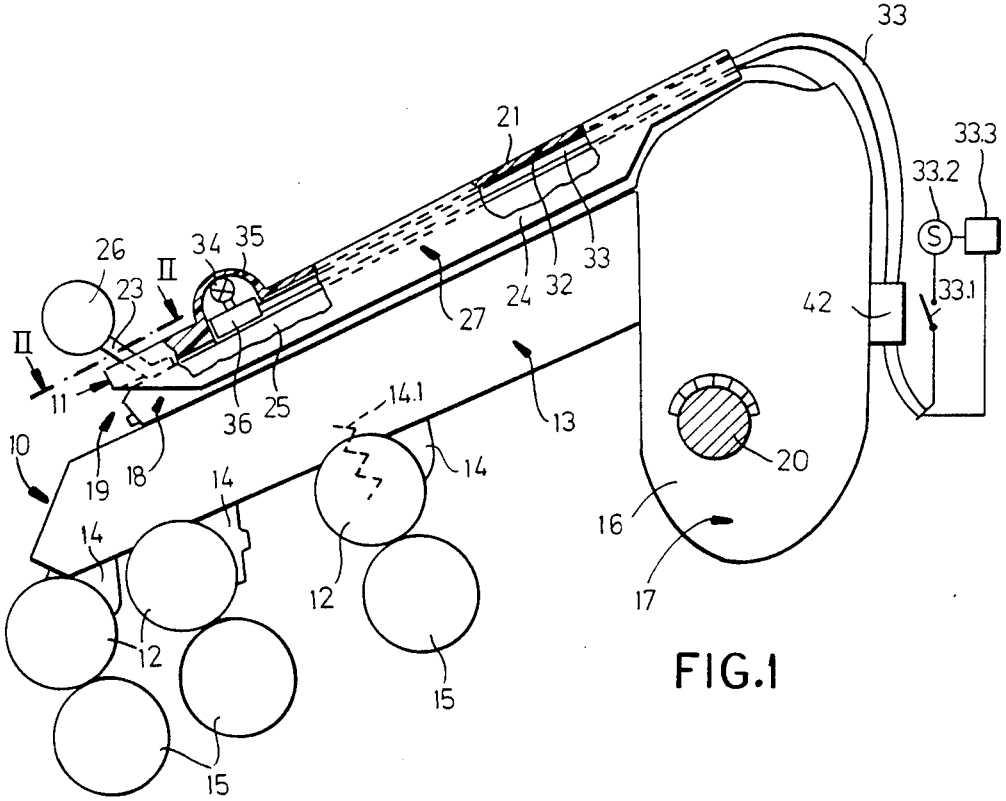
FIG. 1 is a side elevation showing generally schematically a pressure arm assembly with an indicator light shown in part in cross section in accordance with one embodiment of the invention.

The signal lamp 34 is arranged within the confines of a hemispherical, or curved (domed), and transparent lens 35 near the knob 26 and atop the holder 27. As is indicated in FIG. 1, the curved portion is integrally formed with the holder 27. As is also indicated the lens 35 is open in the downward direction and the socket 36 of the lamp 34 can be introduced from below into the lens 35 and is releasably held in clamped or similar manner in the interior of the lens 35.

Accordingly, for replacing a bulb or lamp 34, the socket 36 can be removed from the lens interior upon releasing the holder 27 from the arm 18.

The connecting or supply conduit 33, accordingly, extends from the socket 36 to the rearward end of the holder 27, and the conduit 33 is protected in the channel 32. The conduit 33 further extends from the holder 27 and at a distance in a curved manner around a portion of the support frame 17. A clip 42 at the support frame 17 serves to hold the conduit 33 on the rearward side at the support frame 17. The conduit leads to a switch 33.1 and a source of electric current 33.3. The switch 33.1 is connected to a sensor 33.2 which actuates the switch to light the lamp 34 when a disruption occurs.

It is generally contemplated that the lamp will light up when a disruption occurs, i.e. when the movement of a respective thread, filament, band or the like, is not occurring, e.g. due to a break in the filament, at the two operating stations or spinning stations at which the pressure arm assembly 10 is provided. The lamps can be manually or automatically shut off again when the respective problem has been corrected. A yarn continuity monitor 19 can detect a break and operate the switch SW which turns on the lamp.

Figure 2:
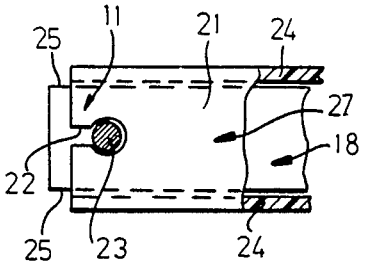
FIG. 2 is a cross-sectional view taken along line II—II in FIG. 1 drawn to a larger scale.

As is more clearly shown in FIG. 2, the slot 22 of the holder 27 is generally shaped in the manner of a keyhole, i.e. with a round of circular portion and with a longitudinal or slot-like portion, and the short rod 23 will rest in the round portion, so that the holder 27 is positionally fixed on or at the short rod 23. Axial or longitudinal shifting of the holder 27 will thus be precluded and the axial or longitudinal position is precisely fixed.

Figure 3:
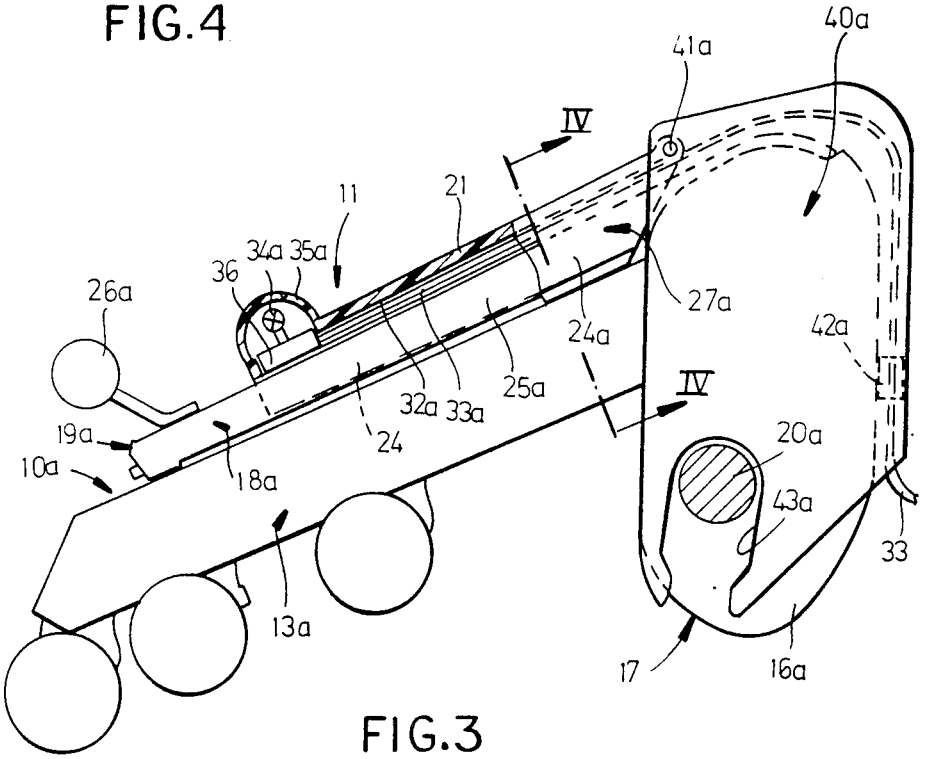
FIG. 3 is a view similar to FIG. 1 showing the pressure arm assembly and with an indicator light shown in part in cross section of a second embodiment of the invention.

The pressure arm assemblies 10*a* according to FIGS. 3 to 5 have certain different features as will be described next. Thus, the longitudinal holder 27*a* shown partly broken away in FIG. 3, is arranged at and on the arm 18*a* of the operating lever 19*a* in frictional and form-locking, as well as in a generally self-supporting manner. This holder 27*a* extends only to a point somewhat away from the short rod 23*a* for the knob 26*a*.

A separate cap 40*a* is provided for the conduit 33*a*, specifically that portion of the conduit which extends from the holder 27*a* around the support frame 17*a* and then in downward direction to the respective source of current. The cap 49*a* is preferably made of an insulating plastic/synthetic material. The rearward portion of the arm 18*a* extends somewhat into the cap 40*a*. The cap 40*a* and the holder 27*a* are swingably mounted with respect to one another by way of a shaft 41*a*.

The cap 40*a* extends with clearance over the two side arms 16*a* of the support frame 17*a* for the pressure arm assembly 10*a*. This cap 40*a* has a yoke-shaped configuration 43*a* near the horizingal shaft 20*a*. Accordingly, in the closed or operating position of the operating lever 19*a* shown in FIG. 3, the walls of slot 43*a* will rest on the shaft 20*a*. The shaft 20*a* is part of the frame of the spinning machine.

The supply conduit 33*a* extends in the longitudinal central channel 32*a* which is open in the downward direction in the holder 27*a* for the lamp 34*a* of indicator light 11*a*. Accordingly, the conduit is additionally protected by being disposed within the cap 40*a*. The conduit is held by a clip 42*a*. The conduit 33*a* is also passed to a switch and a source of electric current, etc. as described in detail with reference to FIG. 1.

Figure 4:
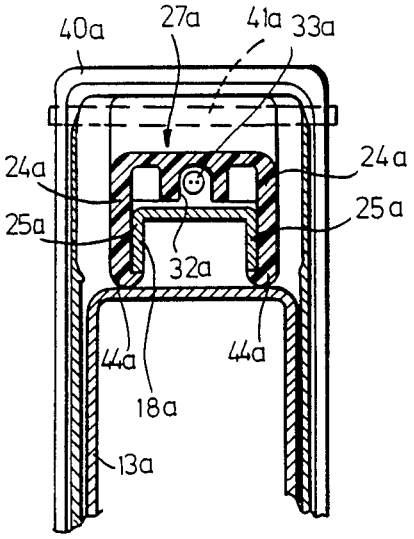
FIG. 4 is a partial cross section along line IV—IV in FIG. 3 with less important components omitted for purposes of greater clarity.

As is most clearly depicted in the cross section according to FIG. 4, the two lateral sides or legs 24*a* of the track-like holder 27*a* for the respective light, are generally over the full length bent or curved inwardly beneath each side or wall 25*a* of arm 18*a* by way of the ledges 44*a*. Thus, the holder 27*a* is secured to the arm 18*a* of the operating lever 19*a* and will be respectively moved together with the arm 18*a*. The axial position of the holder 27*a* on the arm 18*a* is assured by the intensive frictional contact. However, as required, the connection can be reinforced by screws, lugs or similar lock means.

Figure 5:
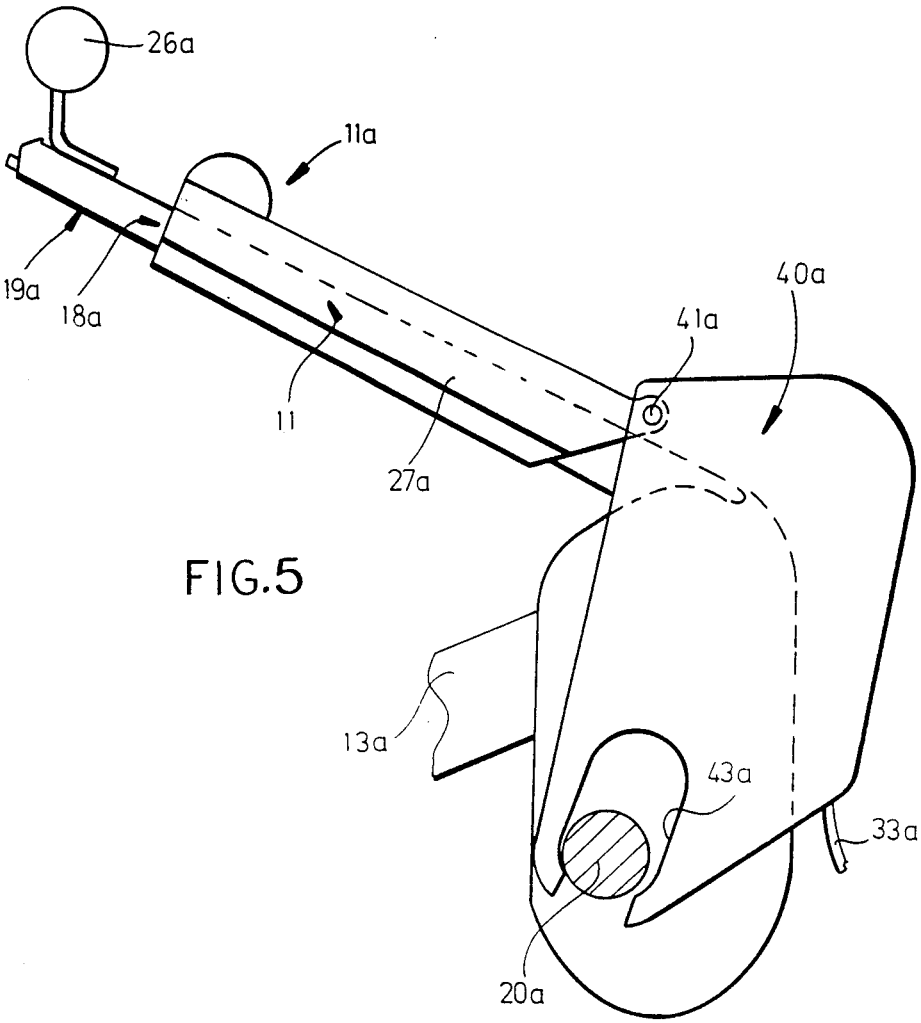
FIG. 5 is a side elevation showing in part the pressure arm assembly of FIG. 2 with the operating lever in the open position.

As shown in FIG. 5, the cap 40*a* can be moved and swung with respect to the support frame 17*a*, specifically the side arms 16*a*. More specifically, when the operating lever 19*a* is swung upwardly, by way of knob 26*a*, with respect to the main arm 13*a*, the cap 40*a* is moved from the position shown in FIG. 3 into the position depicted in FIG. 5. During such swinging or moving the supply conduit 33*a* is protected in the cap 40*a*.

The signal lamp 34*a* and the socket 36*a* carrying it are arranged wtihin a round recess or opening in the upper or top wall 21*a* of the holder 27*a*. The lamp 34*a* extends into an upwardly hemispherical and transparent lens 35*a* of the holder 27*a* so as to be easily seen at the forward end of the holder 27*a*.

FIG. 6 shows a schematic representation of a standard pressure arm assembly 10*b* as made for example by INA, Herzogenaurach, Germany.

It includes a main arm 13*b* and guide elements, not shown. The pressure arm assembly 10*b* supports three upper rollers 12*b*, as is only schematically indicated.

The support frame 17*b* carries the main arm 13*b* which can be swung or pivoted, and the support frame 17*b* is secured to the shaft 20*b*. However, the support frame 17*b* does not extend laterally over the main arm 13*b*. Instead, the support frame 17*b* extends into the downwardly open housing 13.1*b*. The main arm 13*b* is secured in this region which extends into the reach of the main arm 13*b*. Similarly, the rearward end of arm 18*b*, which arm 18*b* rests on the main arm 13*b* in the closed or operating position, extends into the rearward region of main arm 13*b* and is here swingably or pivotally connected at the support frame 17*b*.

The indicator light 11*b* is releasably arranged on the arm 18*b* of the operating lever 19*b*. This light or assembly 11*b* includes a longitudinal holder 27*b* for the respective light. This holder 27*b* is also made of an insulating plastic/synthetic resin/elastomeric material. The holder 27*b* extends in longitudinal direction on the arm 18*b* and its cross section is preferably continuously u-shaped. The holder 27*b* has an upper or top wall 21*b* and lateral legs or members 24*b*. Two hemispherical and transparent lenses 35*b* are provided atop the upper wall 21*b*. In each of the lenses 35*b* is arranged a signal lamp 34*b* with a respective socket 36*b*. In FIG. 6 only one socket and lamp assembly is shown in the broken away portion of the holder 27*b*.

The two supply conduits 33*b* for the respective sockets and the associated lamps 34*b* are also disposed in a protective channel 32*b* as has been described. From this holder 27*b*, the conduits 33*b* extend through a cap 40*b*. The cap 40*b* is provided near the rearward portion of the main arm 13*b* and is releasably secured thereon with the cap 40*b* generally being held in a self-holding condition due to friction and form-locking interaction. The conduits 33*b* are protected in the cap 40*b* and they are retained by a clip 42*b*. The conduits exit from the cap 40*b* at the rearward end, to the right in the drawing FIG. 6. They are passed to a source of current and associated control means as has been previously described.

When the operating lever 19*b* is swung in upward direction by way of the knob 26*b*, for opening the pressure arm assembly 10*b*, the holder 27*b* accompanies the respective swinging movement of this arm 18*b*. However, the cap 40*b* remains in the position in which it has been clamped onto the main arm 13*b* and accompanies the movement of the main arm 13*b*.

The embodiments described previously allow the holders and respective arms a rather simple and protected run or lateral extent of the conduits from the mentioned lamps to the respective support frames. The caps thus contribute to this protection near a respective support frame.

Figure 7:
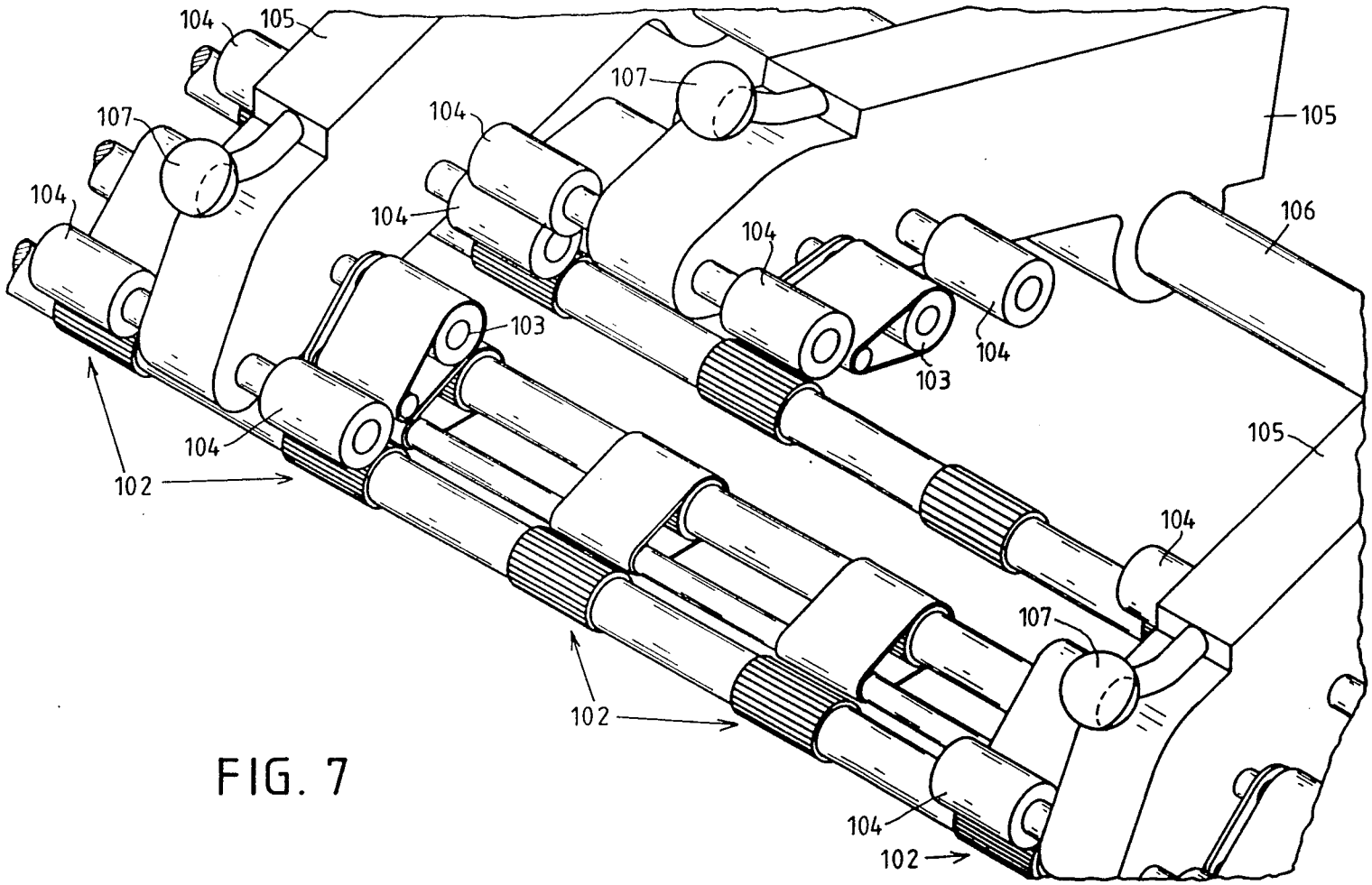
FIG. 7 is a perspective view of a spinning machine equipped with pressure arm assemblies in accordance with another embodiment of the invention.

FIG. 7 is a schematic representation of a portion of a ring spinning or similar machine to produce filaments and the like continuous products. Each pair of drafting devices 102 for example the shown grooved rollers with associated belts, are contacted by corresponding upper rollers 104 or belt systems 103 with the latter also performing the function of upper drafting rollers. The rollers and belts systems are mounted on the pressure arm 105 which arms or assemblies can be swung upwardly by way of a horizontal shaft 106 and the associated operating handle 107. The handles 107 are equipped and designed to perform the function of signal or indicator lights for the signalling of disruptions and the like problems.

Accordingly, the handle 107 as shown in greater detail in FIGS. 8 and 9 has an indicator lamp 108 and the knob or similar spherical member surrounding it is at least in part made of translucent material, for example a red and translucent material.

With further references to FIG. 8, the handle or handle end 107 is a formed by a removable hemispherical cover 109. The cover has external screw threads, while the hemispherical base 111 has corresponding internal screw threads. The screw thread connection of these two parts is generally indicated by the reference numeral 110.

A socket 112 is disposed centrally in the base 111, and the lamp or bulb 108 is held in the socket 112.

A bent holder part 113 connects the base member 111 to the light holder 105. The socket 112 and the associated lamp 108 are connected to a source of current by way of an electrical conduit 115 which includes a male connector 114. The source of current and the associated signal and switching or control means can be arranged at the spinning machine. They can be of the type and for the purpose as described above, FIG. 9 shows that the cover 109 is formed such that it has portions which perform the function of collecting lenses 117 and 118. These lenses are aligned with respect to the longitudinal direction of the spinning machine, as is schematically indicated by the double-headed arrow 116. Accordingly, the rays or signal from the lamp 108 will be bundled or similarly focused and emitted substantially parallel from the cover 109 as is indicated by the representative arrows 130.

The hollow space 119 provided by the cover 109 for the lamp 108 is covered with a light-impervious coating or is otherwise made not to transmit the emanating light, excepting, of course, for the collecting lenses 117 and 118. In accordance with a preferred embodiment this is achieved by provision of mirror surfaces 120 and 121 or similarly reflecting surfaces or configurations.

A modified arrangement is shown in the embodiment in FIGS. 10 and 11. In these the handle 122 is ring-shaped and continuous, i.e. the shape includes a portion 123 which connects it to an associated pressure arm, not shown in this embodiment. The configuration of the profile of the portion 123 and of the eyelet or hook-shaped is indicated in FIG. 11.

Thus, the signal lamp or bulb 124 is centrally disposed in the hollow interior of the eyelet configuration. The lamp 124 is secured in the socket 125. The sides of the eyelet configuration are closed by circular collecting lenses 126 and 127. Both lenses are made of a colored plastic/synthetic material. The lenses can be secured by way of clipping or clamping action or in other ways which will ensure that they are positively retained for their purpose. Again a handle or grip of generally spherical configuration is provided by this structure.

We claim:

1. In a spinning machine, especially a ring or flyer spinning frame, said machine including:

lower drafting rollers mounted on said machine for each spinning station;

a movable pressure arm assembly for each station, said pressure arm assembly comprising:

a main arm, a plurality of upper rollers mounted on said main arm and juxtaposed with respective lower rollers, spring means connected to said main arm for exerting pressure on said upper rollers, guides for said upper rollers, and at least one operating lever arranged above said main arm and swingably connected with respect thereto for selectively shifting said main arm into a pressure exerting position and into an inoperative position, the improvement which comprises the combination therewith of at least one signal light unit directly on said operating lever for indicating disruption at a respective station.

2. The improvement according to claim 1 in which a respective one of said signal light units is located at each station.

3. The improvement according to claim 2 wherein said holder is releasably connectable to said operating lever.

4. The improvement according to claim 1, further comprising:

at least one swingable arm forming a respective operating lever of a respective pressure arm assembly, said swingable arm being mounted such that in its closed position it extends along, and lies on, the main arm of the respective pressure arm assembly;

a holder for at least one signal light unit, said holder being arranged at its respective operating lever; and at least one signal lamp for said signal light unit and carried by said holder.

5. The improvement according to claim 4 wherein said holder is a longitudinal member having a substantially continuous u-shaped cross section.

6. The improvement according to claim 5 wherein said holder includes a central channel formation, said channel formation extending in the longitudinal direction of and towards said holder, and further comprising:

at least one electrical supply conduit for supplying electrical power to a respective signal light unit.

7. The improvement according to claim 5 wherein said holder includes at least one window in at least one downwardly directed wall of its u-shaped cross section.

8. The improvement according to claim 4, further comprising:

a support frame for said pressure arm assemblies, said support frame including at least two lateral walls, with each wall being adapted to journal a respective main arm and the respective swingable arm of a respective operating lever; and a cap releasably and movably mounted on said support frame, said cap at least in part extending over associated ones of said at least two lateral walls, and said cap including in its interior holding means for the respective electrical supply conduit for said at least one signal light unit.

9. The improvement according to claim 8 wherein said holding means includes a clip fixed to said support frame.

10. The improvement according to claim 8 and further comprising:

a shaft secured to said support frame;

wherein said cap is guided on said shaft and is swingably linked to the respective holder for a light unit.

11. The improvement according to claim 1 further comprising:

at least one swingable arm forming a respective operating lever of a respective pressure arm assembly, said swingable arm being mounted such that in its closed position it extends along, and lies on, the main arm of the respective pressure arm assembly;

a holder for a respective signal light unit, said holder being arranged at its respective operating lever;

at least one signal lamp disposed in its signal light unit, said lamp being carried by said holder; and a support frame for mounting thereon respective support arm assemblies;

wherein said holder has a longitudinal configuration and extends in the longitudinal direction of said swingable arm, and wherein a respective signal light unit is mounted above the forward half, when considered with respect to the longitudinal direction, which is directed away from the respective support frame of its pressure arm assembly.

12. The improvement according to claim 1 wherein said main arm is shaped to provide an interior space, further comprising:

a support frame for said pressure arm assemblies, said support frame being fixed at said spinning machine and extending into said interior space of said main arm;

at least one swingable arm for a respective operating lever of a respective pressure arm assembly, said swingable arm being mounted such that in its closed position it extends along, and lies on, the main arm of the respective pressure arm assembly;

wherein the respective mounting locations of said main arm and said at least one swingable arm for displacement thereof are arranged at said support frame in said interior space of said main arm;

a cap releasably arranged at the respective rearward terminal portion of said main arm, into which said support frame extends, said cap providing an interior space; and holding means for the respective electrical supply conduit of a respective signal lamp of at least one signal light unit.

13. The improvement according to claim 1 wherein at least one signal light unit is arranged at each operating lever of a respective pressure arm assembly.

14. The improvement according to claim 1 wherein selected operating levers are equipped with at least one signal light unit.

15. A spinning frame comprising:

a machine support;

a plurality of movable pressure arm assemblies disposed on said support, each of said assemblies including a main arm, and at least one operating lever arranged above said main arm and swingable connected with respect thereto, said operating lever being adapted to function as the operating handle for selectively shifting the main arm into a pressure exerting position and into an inoperative position; and a signal light unit on said operating lever to indicate disruptions at a work location near said main arm.

16. The spinning machine according to claim 15 wherein said signal light unit is at least in part formed of transparent or translucent material.

17. The spinning machine according to claim 15 wherein said signal light unit includes a spherical handle-knob for manually operating said lever.

18. The pressure arm assembly according to claim 15 and including at least one releasable cover for a respective operating handle.

19. The pressure arm assembly according to claim 15 wherein the respective signal lamp of a light unit is connected to a flexible electrical conduit, said conduit having a male plug-contact and being connectable to a disruption-indicator provided at said spinning machine.

20. The pressure arm assembly according to claim 15 wherein said signal light unit includes collecting lenses which are aligned in the longitudinal direction of said spinning machine.

* * * * *